United States Patent [19]

Rosenfeld

[11] 4,111,734

[45] * Sep. 5, 1978

[54] DRY TRANSFER PRODUCT AND PROCESS FOR USING SAME

[76] Inventor: Jerome E. Rosenfeld, 1349 Lexington Ave., New York, N.Y. 10028

[ * ] Notice: The portion of the term of this patent subsequent to Jun. 14, 1994, has been disclaimed.

[21] Appl. No.: 797,078

[22] Filed: May 16, 1977

Related U.S. Application Data

[63] Continuation-in-part of Ser. No. 695,790, Jun. 14, 1976, Pat. No. 4,028,165.

[51] Int. Cl.[2] ..... B44C 1/16

[52] U.S. Cl. ..... 156/234; 156/240; 427/147; 428/203; 428/204; 428/207; 428/914

[58] Field of Search ..... 156/230, 234, 239, 240, 156/247, 249; 427/146, 147, 152, 256, 258; 428/195, 201-207, 480, 483, 914

[56] References Cited

U.S. PATENT DOCUMENTS

| | | | |
|---|---|---|---|
| 3,519,456 | 7/1970 | Reed et al. | 428/207 |
| 3,589,962 | 6/1971 | Bonjour | 156/233 |
| 3,684,545 | 8/1972 | Worrall | 428/202 |
| 3,728,210 | 4/1973 | Piron | 428/202 |
| 3,894,167 | 7/1975 | Kluge et al. | 428/40 |
| 4,021,591 | 5/1977 | DeVries et al. | 428/200 |
| 4,028,165 | 6/1977 | Rosenfeld | 156/234 |

*Primary Examiner*—George F. Lesmes
*Assistant Examiner*—Bruce H. Hess
*Attorney, Agent, or Firm*—Arthur A. Jacobs

[57] ABSTRACT

A dry transfer material comprising a carrier sheet of from about 0.001 inch to 0.0025 inch thickness, which may include a polymeric coating or a release chemical treatment, inked indicia printed thereon, and a pressure sensitive adhesive overlying said indicia, said dry transfer material being self-adherent to surfaces, without fastening or external support, prior to transfer of the indicia, under the application of light rubbing or burnishing.

9 Claims, 2 Drawing Figures

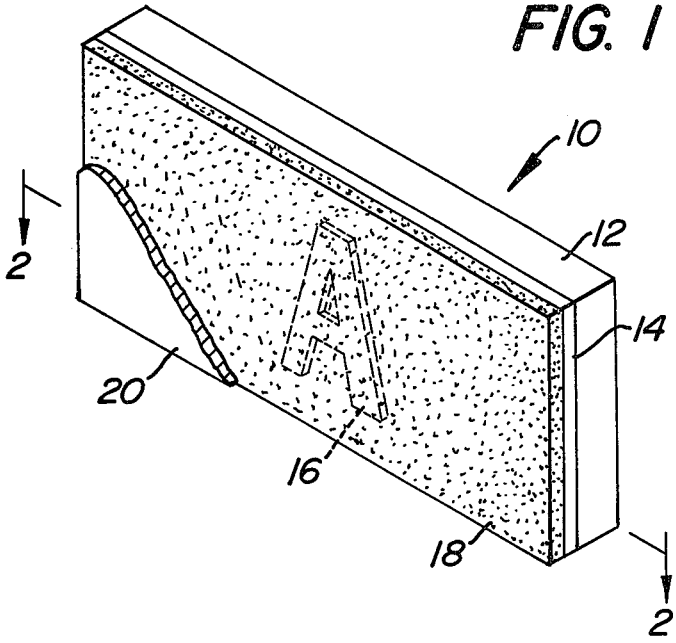
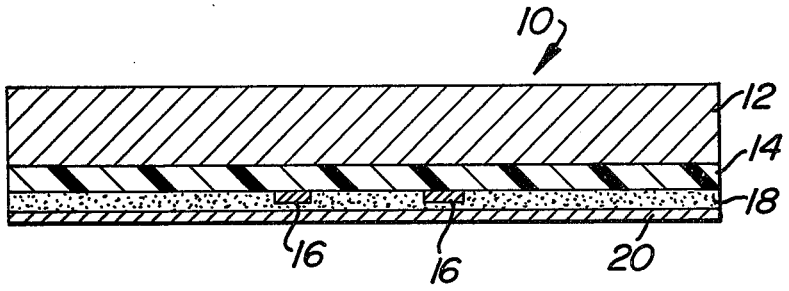
FIG. 2

DRY TRANSFER PRODUCT AND PROCESS FOR USING SAME

This application is a continuation-in-part of application Ser. No. 695,790 filed June 14, 1976, now issued as U.S. Pat. No. 4,028,165, dated June 7, 1977.

This invention relates to new and improved self-adherent dry transfer materials and methods for their use.

As stated in applicant's co-pending application Ser. No. 695,790, the transfer of indicia from one surface to another has long been used in the graphic arts field for the creation of advertising media and art work. Among the older methods of transfer were those which employed water to effect transfer of the indicia. These generally involved the printing of indicia upon a transparent carrier sheet adhered to a support sheet by a water-soluble adhesive. Water was used to soften the adhesive and permit removal of the transparent carrier sheet from the support sheet, after which the carrier sheet, with the indicia thereon, was applied to a receptor surface. The disadvantages of such "wet process" technique were the difficulty in positioning the carrier sheets properly, as well as the cumbersomeness of their application and their unsuitability for many purposes.

More recently, a number of techniques have been developed which eliminate the need for treatment with water to effect release from the support sheet. These are generally referred to as "dry transfer" processes. The elements of the more advanced "dry transfer" techniques generally involve, first, the printing of indicia upon a supporting or carrier sheet, then the superimposition of an adhesive film, having pressure-sensitive properties, upon the indicia. The images are transferred from the carrier sheet to the adhesive film by placing the laminate, adhesive side down, upon a receptor surface and applying pressure by rubbing or burnishing the back of the carrier sheet above the indicia. Due to the lower degree of adhesion of the indicia to the carrier sheet than to the pressure-sensitive adhesive, when subjected to the pressure of the burnishing or rubbing, the indicia is released from the carrier sheet to the receptor surface.

A number of dry transfer materials have been developed along the lines described above. One technique employs indicia which have a low degree of adhesion to the carrier film, which may include a polymeric coating. The indicia-forming inks used in such systems are formulated with additives to decrease the adhesion between the carrier film and the indicia.

Another method employs a carrier sheet treated with release chemicals having comparatively low surface energy, such as silicones, hydrocarbon and ester waxes, fluorochemicals, etc. These adhesive treatments facilitate the release of indicia printed thereon.

Another dry transfer system employs a microencapsulated adhesive applied to the indicia printed on a carrier sheet.

Yet another method employs a transferable cohesive pressure-sensitive indicia-forming ink printed on a carrier sheet.

Still another "dry transfer" method involves the application of indicia to a carrier sheet and coating the indicia with a pressure-sensitive adhesive. The carrier sheet that is used in this system is a material which is capable of stretching when subjected to the mechanical forces of rubbing or burnishing. The separation of the indicia occurs during the stretching of the carrier sheet.

In contrast, as described in the aforesaid co-pending application Ser. No. 695,790, a superior dry transfer material is constructed of a non-extensible carrier film which includes an essentially non-extensible solvent-susceptible, polymeric coating upon which indicia and pressure-sensitive adhesive are superimposed.

All of the above systems, as well as others known to the art, may be employed to transfer printed indicia onto surfaces in general, but when applied to vertical surfaces such as walls or "unsupported" horizontal surfaces such as ceilings or the underside of horizonally positioned objects, these systems require manual support or mechanical or adhesive fastening prior to transfer in order to facilitate superpositioning. Without provision for fastening it becomes physically impossible for one person to employ transfer sheets covering large areas. Temporary adhesive or mechanical fastening is undesirable because of the inherent potential for damage or marring of surfaces.

An object of the present invention, therefore, is to provide a new and improved "dry transfer" system which overcomes the aforesaid limitations and disadvantages of prior "dry transfer" system.

A further object of this invention is to provide a "dry transfer" material which self-adheres to vertical and "unsupported" horizontal surfaces prior to transfer without recourse to adhesive or mechanical fastening to permit alignment.

A further object of the present invention is to provide "dry transfer" decals with tough and durable indicia, particularly suitable for application to surfaces such as walls, furniture and other articles subject to abrasion or scratching, as well as to the action of detergents and abrasive cleaners.

Yet another object of the present invention is to provide a "dry transfer" product having uniform transfer characteristics under light rubbing or burnishing and having indefinite shelf life.

Other objects are many of the attendant advantages of this invention will be readily appreciated as the same becomes better understood by reference to the following description, when read in conjunction with the accompanying drawings wherein:

FIG. 1 is a perspective view of a dry transfer material embodying the present invention.

FIG. 2 is a cross-sectional view of the material of FIG. 1 as applied to a receptor sheet.

According to the present invention, a dry transfer material is provided which comprises a carrier sheet, a transferable indicia layer applied to the carrier sheet, and an outermost layer of pressure-sensitive adhesive. The carrier sheet includes a polymeric coating having a low modulus of elongation and, contrary to prior teachings, preferably susceptible to the adsorption and desorption of solvents commonly used in printing inks.

More specifically, the carrier sheet is essentially non-extensible under normal conditions of burnishing and is of pellucid quality in order to permit accurate positioning of the indicia during transfer. Acceptable carrier sheets include polyester and other light-transmitting polymer films of low-extensibility under the stresses encountered under light rubbing or burnishing conditions.

The carrier sheets of this invention have thicknesses of about 0.001 inch. Particularly suitable are certain grades of polyester films which require tensile stresses greater than 10,000 psi to produce elongation of about 5%.

Surprisingly, it has been found that if the thickness of the carrier sheet, including polymeric coating or release chemical treatment, is limited to about 0.001 to 0.0025 inch, the advantageous property of self-adherence to surfaces is present in the final dry transfer product.

Referring in greater detail to the drawings wherein similar reference characters refer to similar parts, the dry transfer material, generally designated 10, comprises a carrier sheet or film 12 made of polyester or the like, on which is applied a polymeric coating 14. The coating 14 should have a pellucid quality and, preferably, should have a dimensional stability similar to that of the film 12 to which it is applied. The coating may be provided in either a smooth or matte finish, but it is preferable that the coating be susceptible to penetration by the solvents normally employed in the formulation of printing inks, such as used to form the indicia shown in the form of a printed A at 16.

Unexpectedly, it has been found that such inks can be applied without apparent effect on the bond between the carrier sheet and the coating and without ultimate effect on the integrity of the polymeric film. This property permits a more positive and uniform control of the degree of adhesion of the indicia to the carrier sheet and greatly simplifies the problem of formulating inks to provide adequate wetting with good definition of the indicia, while maintaining a sufficient and uniform degree of adhesion of the indicia to the carrier film sufficient to prevent premature release on storage and handling.

Among the polymeric coatings which may be used for the present purpose are resins which are good film formers and which are capable of both good solvent absorption and good solvent release. Examples of such materials are phenol-formeldehyde resins, styrenated alkyd resins, styrenated oils, rosin, maleic anhydride resins, epoxy resins, as well as certain other thermosetting and thermosplastic resins, and may be photocurable, self-curing or preformed. They may be applied by roller-coating or any other suitable means.

The following is illustrative of the invention:

EXAMPLE 1

A styrenated-alkyd resin coating was applied to a polyester film and then exposed to a number of chemicals frequently used as ink solvents. These included aromatic hydrocarbons such as benzene, toluene, xylene, trimethyl benzene, aromatic naphtha and nitrobenzene; esters such as butyl acetate, amyl acetate, ethylene glycol acetate, butyl lactate and ethyl lactate; ketones such as acetophenone, methyl ethyl ketone, methyl propyl ketone, methy amyl ketone, methyl isobutyl ketone, methyl hexyl ketone, cyclohexanone, methyl hexanone, diacetone alcohol and acetone; and ether alcohols such as butyl ether or ethylene glycol, methyl ether or ethylene glycol, butyl ether of diethylene glycol, nitropropanes, and mixtures thereof.

Penetration of each solvent into different areas of the resin was detected after brief exposures of from about 30 seconds to 5 minutes by lightly wiping the exposed area with cheese cloth to remove the polymeric coating from the supporting film After the solvents are removed and the coating is dried, the coating cannot be removed by ordinary wiping. As an example of this, in a series of parallel exposures, the coating was treated with the solvents mentioned above; but subsequent to an exposure of about 30 seconds to about 5 minutes, the treated coating was heated in a forced-air oven for about 5 to 10 minutes at a temperature of between about 100°–140° F. The areas of coating previously exposed to the solvent remained essentially unaffected and could not be removed by wiping; they remained intact and firmly adhered to the substrate.

Since the dry transfer products of this invention may be exposed to abrasion, the indicia-forming ink should preferably contain film-forming ingredients of high mechanical strength. These films should have a high sheen and should be tough and of high tensile strength in order to withstand the stress of burnishing and have satisfactory durability after transfer to the reception surface. Preferably, these inks are based on polymers such as nitrocellulose, polyacrylate or polyvinyl chloride-polyvinyl acetate copolymers and their mixtures. Without being bound by any particular theory, it appears that the diffusion of solvent from the ink layer and its subsequent evaporation causes softening or plasticizing at the surface of the polymeric coating, permitting a more uniform distribution of the physical force responsible for adhesion. In this manner, it is possible to provide the uniform but limited degree of adhesion that is required for ready release under the stress of burnishing the carrier film, while avoiding any nonuniform or premature release under ambient conditions.

A distinct advantage over prior "dry transfer" products is provided by the good wettability of the polymeric coating used in the process of the present invention. In this manner, it is possible to combine satisfactory adhesion with good indicia definition.

The adhesive, shown at 18, which is employed in the present invention, may be applied to register with the indicia or over both the indicia and the areas of the polymeric coating surface not covered by the indicia. Since it is frequently necessary to place the "dry transfer" decal against the receptor surface, shown at 20 in FIG. 2, and move it into desired position, the adhesive 18 should, preferably, be one which will be substantially non-adherent to the receptor surface 20 under light pressure; for example, a pressure of at least about 50 psi, which may be produced by rubbing or burnishing the supporting or carrier sheet. Pressured sensitive adhesives of this type are considered to have low dry tack.

The adhesive should be chosen so that the degree of adhesion of the adhesive to the indicia film and the adhesive film to the receptor surface is greater than that of the indicia for the polymeric coating of the carrier sheet when localized pressure is applied to the carrier sheet opposite the indicia. Additionally, it is desirable to use an adhesive which adheres to the polymeric coating to a greater degree than to the receptor surface. This avoids the transfer of adhesive from areas overlapping the indicia when pressure is applied to the carrier film in the vicinity of the indicia. As the indicia is adhered to the receptor surfaces by burnishing, it shears the adhesive along the outline of the indicia so that, essentially, none of the overlapping adhesive is transferred.

In order to acheive the above result, the pressure-sensitive adhesive should not be a highly cohesive film former. Proper formulation of polymers, tackifiers and fillers achieve this result. Adhesive based on natural rubber and synthetic rubber such as styrenebutadiene, polyisobutylene, polycis-1,4-isoprene are suitable.

Using the proper combination of a support or carrier sheet, ink and adhesive selected to provide the aforementioned properties, a dry transfer decal was prepared as follows:

EXAMPLE 2

A 0.45 mil. thickness polyester film of low extensibility coated with a styrenated alkyd resin of nominal 0.5 mil, thickness, was printed with a lacquer-type printing ink of the following composition:

| Components | Parts by Wt. |
|---|---|
| vinyl chloride/vinyl acetate, copolymer | 100 |
| polyester plasticizer | 20 |
| cyclohexanone | 190 |
| carbon black | 15 |

The ink was dried in a continuous feed forced-air oven and then coated with a pressure-sensitive adhesive of the following composition:

| Components | Parts by Wt. |
|---|---|
| Polycis-1,4-isoprene | 5.5 |
| polyterpene resin | 9.5 |
| silica filler | 3.0 |
| antioxidant | 0.3 |
| naptha | 40.0 |
| mineral spirits | 40.0 |

After drying, the dry transfer sheet was first placed against a painted plaster wall and then against a ceiling, and found to be self-adherent in both cases. After proper alignment of the sheet, the indicia was easily transferred by light rubbing of the outer surface of the carrier sheet.

The dry transfer sheets of Example 1 remained unchanged after storage of at least 1 year, and the indicia remained uniformly adhered to the carrier sheet until transferred.

Dry transfer products prepared in an identical manner but having a polyester carrier sheet including polymeric coating of 2.0 mil and 2.5 mil thickness were respectively found to be similary "self-adherent".

By contrast, a dry transfer product identically prepared but having polyester carrier sheet including polymeric coating of 3.5 mil. thickness did not "self-adhere".

Although, as previously noted in the aforesaid copending application, the dry transfer products prepared with carrier sheets including a solvent-susceptible, essentially non-extensible polymeric coating, are particularly advantageous, a solvent-inert, essentially non-extensible polymeric coating comprising an essentially non-extensible cross-linked, modified thermosetting acid-catalyzed urea-formaldehyde resin coating, when similarly applied to polyester film, also has the property of forming a "self-adherent" dry transfer product provided that the thickness of the carrier sheet is limited to the range of from about 1 mil to 2.5 mil (about 0.001 to 0.0025 inch).

The invention claimed is:

1. A dry transfer material comprising a non-extensible carrier sheet constructed of a light-transmitting polymer film of low extensibility under the stresses of light rubbing or burnishing, said sheet having a polymeric surface layer which is substantially non-extensible, ink-printed indicia on said polymeric surface layer, said indicia being capable of being transferred to a receptor surface without the application of heat, and a pressure-sensitive adhesive coating overlying said indicia, said material being self-adherent to a receptor surface to which it is applied, said carrier sheet having a thickness of about 0.001 to 0.0025 inch.

2. The material of claim 1 wherein said surface layer is susceptable to penetration by ink-carrying solvents.

3. The material of claim 1 wherein said surface layer is not susceptable to penetration by ink-carrying solvents.

4. The material of claim 1 wherein said adhesive coating has greater adhesion to said indicia than the indicia has to said surface layer.

5. The material of claim 1 wherein said adhesive coating overlies both the indicia and the surface layer and has greater adhesion to said surface layer than to a receptor surface to which said material is applied.

6. The material of claim 1 wherein said ink-printed indicia is formed by an ink based upon a member selected from the group consisting of nitrocellulose, polyacrylate, polyvinyl chloride-polyvinyl acetate copolymers, and mixtures thereof.

7. The material of claim 1 wherein said ink-carrying solvents are selected from the group consisting of aromatic hydrocarbons, esters, ketones, and ether alcohols.

8. A method of transferring indicia from one surface to another which comprises applying a self-adherent transfer material to a receptor surface by placing the transfer material against the receptor surface and causing adherence therebetween in the absence of other fastening means, said transfer material comprising a non-extensible carrier sheet constructed of a light-transmitting polymer film of low extensibility under the stresses of light rubbing or burnishing, said sheet having a polymeric surface layer which is substantially non-extensible, ink-printed indicia on said polymeric surface layer, said indicia being capable of being transferred to a receptor surface without the application of heat, and a pressure-sensitive adhesive coating overlying said indicia, and then applying a predetermined pressure, at ambient temperature, to said transfer material to transfer said indicia and the adhesive coating overlying said indicia to said receptor surface.

9. The method of claim 8 wherein said carrier sheet has a thickness of about 0.001 to 0.0025 inch.

* * * * *